US007828284B2

(12) United States Patent
Coret et al.

(10) Patent No.: US 7,828,284 B2
(45) Date of Patent: Nov. 9, 2010

(54) MAILPIECE SELECTOR DEVICE HAVING AN ADJUSTABLE GUIDE

(75) Inventors: Francis Coret, Gournay sur Marne (FR); Yannick Claris, Fontenay aux Roses (FR)

(73) Assignee: NEOPOST Technologies, Bagneux (FR)

( * ) Notice: Subject to any disclaimer, the term of this patent is extended or adjusted under 35 U.S.C. 154(b) by 95 days.

(21) Appl. No.: 12/361,194

(22) Filed: Jan. 28, 2009

(65) Prior Publication Data

US 2009/0194932 A1 Aug. 6, 2009

(30) Foreign Application Priority Data

Jan. 31, 2008 (FR) ..... 08 50630

(51) Int. Cl.
*B65H 3/56* (2006.01)

(52) U.S. Cl. ..... 271/124

(58) Field of Classification Search ..... None
See application file for complete search history.

(56) References Cited

U.S. PATENT DOCUMENTS 4,930,764 A 6/1990 Holbrook et al.
5,112,037 A 5/1992 Holbrook
5,599,011 A 2/1997 Schnorr et al.
5,946,996 A 9/1999 Oussani, Jr. et al.
6,193,231 B1 * 2/2001 Hannon ..... 271/131
6,244,587 B1 * 6/2001 Hermander ..... 271/124

FOREIGN PATENT DOCUMENTS

EP 0 195 348 A1 9/1986
JP 63071044 A * 3/1988

* cited by examiner

*Primary Examiner*—Gene Crawford
*Assistant Examiner*—Gerald W McClain
(74) *Attorney, Agent, or Firm*—Sughrue Mion, PLLC

(57) ABSTRACT

A mailpiece selector device including at least one guide co-operating with a plurality of opposite selector rollers passing through a deck for receiving a stack of mailpieces. The guide co-operating with the rollers to select the mailpieces one-by-one and to transport them downstream. The guide presenting a predetermined inclination at an angle θ relative to a horizontal plane defined by the deck, with a distance between the deck and a low end portion of the guide that is larger at the portion of the guide that is closer to a referencing wall than at the portion of the guide that is further away from the referencing wall.

8 Claims, 2 Drawing Sheets

MAILPIECE SELECTOR DEVICE HAVING AN ADJUSTABLE GUIDE

This application claims priority from French Application No. 0850630, filed Jan. 31, 2008, the entire disclosure herein incorporated by reference.

TECHNICAL FIELD

The present invention relates to the field of mail handling, and it relates more particularly to a device for selecting mailpieces that is implemented in an automatic feed module or "feeder" of a franking machine or "postage meter" for franking mailpieces.

PRIOR ART

Conventionally, a franking machine must be adapted to receive various types of mailpiece, such as documents, letters, or envelopes of greater or lesser thickness, typically lying in the range 0.1 millimeters (mm) to 16 mm. To this end, on the upstream side, it is often provided with an automatic feed module making it possible, in particular, to convey said mailpieces at various speeds. That automatic feed module usually includes means for receiving/stacking, selecting, transporting, and possibly closing said mailpieces. The means for receiving/stacking the mailpieces conventionally include jogging means for pressing the mailpieces against a referencing wall. Said jogging means can be of different types.

U.S. Pat. No. 5,112,037 discloses inclining the deck both backwards and towards the referencing wall so as to bring the mailpieces properly into reference, the open flaps of the mailpieces then being received in a slot.

U.S. Pat. No. 4,930,764 discloses inclining the drive rollers so as to drive the mailpiece downstream while also jogging it transversely towards the referencing wall.

Those solutions are generally satisfactory. However, when the stack of mailpieces diminishes and when there are only a few mailpieces remaining to select, those last remaining mailpieces still being satisfactorily jogged against the referencing wall, then one after another said mailpieces lose their alignment and are skewed on coming into contact with the guide of the mailpiece selector device. Since the thickness of a mailpiece is never constant over its entire width, in particular because of the extra thickness of its flap, said last remaining mailpieces tend, on coming into contact with the guide, to pivot about the blocking point formed by the portion of the guide where the mailpiece thickness is the largest. As a result, the rear portion of the mailpiece tends to come away from the referencing wall because its front portion, and more precisely, its bottom corner, which is thinner, passes under the guide first.

OBJECT AND DEFINITION OF THE INVENTION

An object of the present invention is to mitigate such skewing of the mailpieces due to the extra thickness of the flap by proposing a mailpiece selector device whose guide is specially adapted to enable the mailpiece to be straightened up.

This object is achieved by a mailpiece selector device comprising a guide co-operating with a plurality of opposite selector rollers passing through a deck for receiving a stack of mailpieces, said guide co-operating with said rollers to select said mailpieces one-by-one and to transport them downstream, wherein said guide presents a predetermined inclination at an angle θ relative to a horizontal plane defined by said deck, with a distance between said deck and a low end portion of said guide that is larger at the portion of said guide that is closer to a referencing wall than at the portion of said guide that is further away from said referencing wall.

By inclining the guide at an angle θ in this way, it is possible to straighten up mailpieces that, without said inclination, would tend to skew, and said mailpieces are thus kept properly jogged against the referencing wall.

Preferably, said guide has a body that is hinged about a pivot axis and that can pivot in opposition to resilient return means as the mailpieces pass over said plurality of selector rollers, and a front portion forming a comb that is fastened to said body, a selector finger coated with a wear-resistant material being fastened to the end of each of the teeth of said comb, the wear-resistant material advantageously being a ceramic or a carbide.

Preferably, said body of the guide is made of a plastics material.

In an advantageous embodiment, said inclination at said angle θ is obtained by asymmetric adjustment means acting by deforming said body of the guide. Said asymmetric adjustment means comprise two screw-and-nut sets, each of which acts in opposition to an abutment that is stationary relative to a framework of the device, each of said two screw-and-nut sets being mounted in two portions disposed on either side of the body.

Advantageously, said portion of the body receives a stationary nut into which an adjustment screw is screwed, which screw is held snugly in said portion of the body by a resilient element.

The invention also provides a mailpiece feeder for a franking machine, which feeder includes an above-mentioned mailpiece selector device.

BRIEF DESCRIPTION OF THE DRAWINGS

Other characteristics and advantages of the present invention appear more clearly from the following description given by way of non-limiting indication and with reference to the accompanying drawings, in which.

DETAILED DESCRIPTION OF A PREFERRED EMBODIMENT OF THE INVENTION

An automatic mailpiece feed module conventionally has a feed zone formed essentially by a deck defining a horizontal plane, which deck is designed to receive a stack of mailpieces and includes first transport rollers for driving the mailpieces downstream (and against a referencing wall) at a separation zone having a separator device in which the mailpieces are extracted one by one from the stack of mailpieces. Second transport rollers are, in general, provided at the outlet of said separation zone for the purpose of conveying the mailpieces extracted in this way downstream. Such an automatic feeder is, for example, illustrated in European Patent EP 0 856 483.

Figure 1:
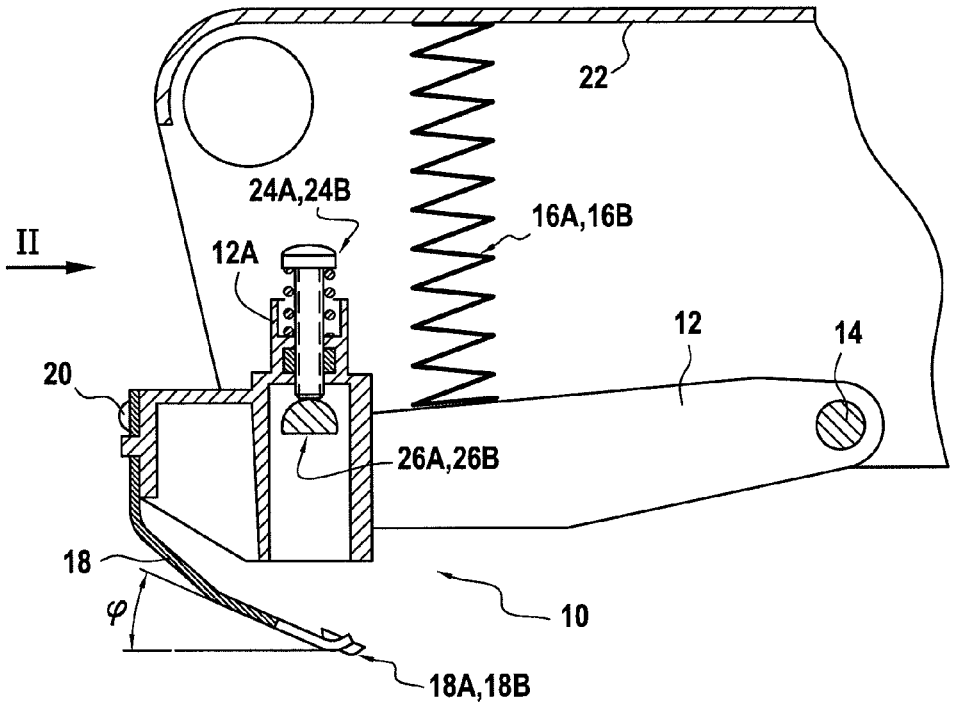
FIG. 1 is a longitudinal section view of a mailpiece selector device of the invention.
Figure 2:
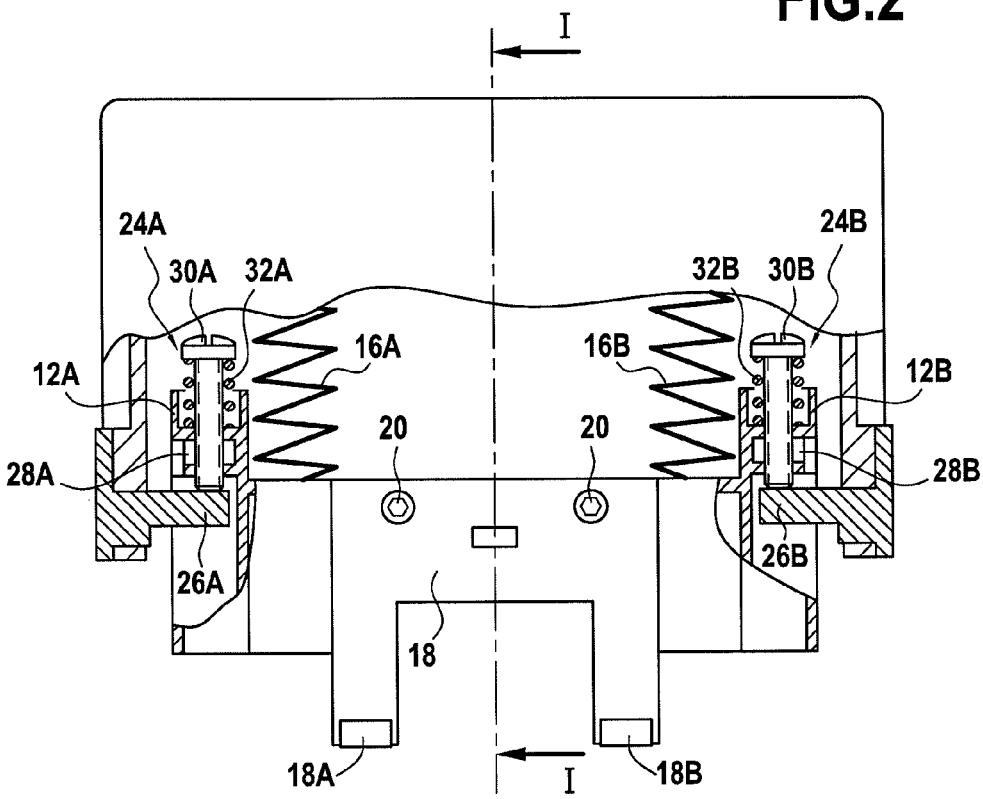
FIGS. 2 and 2A are partially cutaway front views of the guide with the selector device of FIG. 1 respectively in a neutral position and in an operating position.

FIGS. 1 and 2 show, more precisely, a mailpiece separator device of the invention that essentially comprises a guide 10 that co-operates with a plurality of opposite selector rollers (not shown) passing through the deck (not shown either) to select a single mailpiece only and to transport it downstream. Naturally, depending on the required selection performance, as measured by the number of double passes (i.e. the number of times two mailpieces go through together) allowed for a given quantity of mailpieces, this first guide can be followed by a second guide that is declutchable, as is known, by means of a manual operating lever.

In the embodiment shown, the single guide is made up of two portions, namely, firstly a body 12 made of a plastics material, hinged about a pivot axis 14, and mounted to pivot in opposition to resilient return means, e.g. a compression spring 16A, 16B, as the mailpieces pass over the selector rollers, and secondly a front portion made of metal and forming a comb 18 fastened to the body of the guide by fastener means, e.g. screws 20, a selector finger 18A, 18B coated with a wear-resistant material such as a ceramic or a carbide being fastened to the end of each of the teeth of the comb. As is known, in its active portion, the guide is not placed perpendicularly to the mailpiece transport path but rather it is inclined downstream (along the X axis), in a plane perpendicular to the referencing wall, by an angle $\phi$ of about 45° relative to said mailpiece transport path. In addition, the resilient return means also bear against a portion of framework 22 of the selector device.

It should be noted that, although, by way of example, reference is made to a compression spring, a traction spring could also be suitable subject to having a different configuration for fastening the spring to the framework.

Due to its material, the selector finger does not wear while also limiting the risks of the mailpieces being scratched. An example of the ceramic material forming each finger 18A of the comb 18 of the guide 10 is given by a titanium oxide, such as Ti-Cord from the French supplier Saint-Gobain, deposited by heat transfer. This procures very high hardness for the selector finger which can be kept in place throughout the life of the feeder, and the roughness of the material is sufficient to grip the mailpieces firmly while also preventing any tearing as they go past.

Figure 2A:
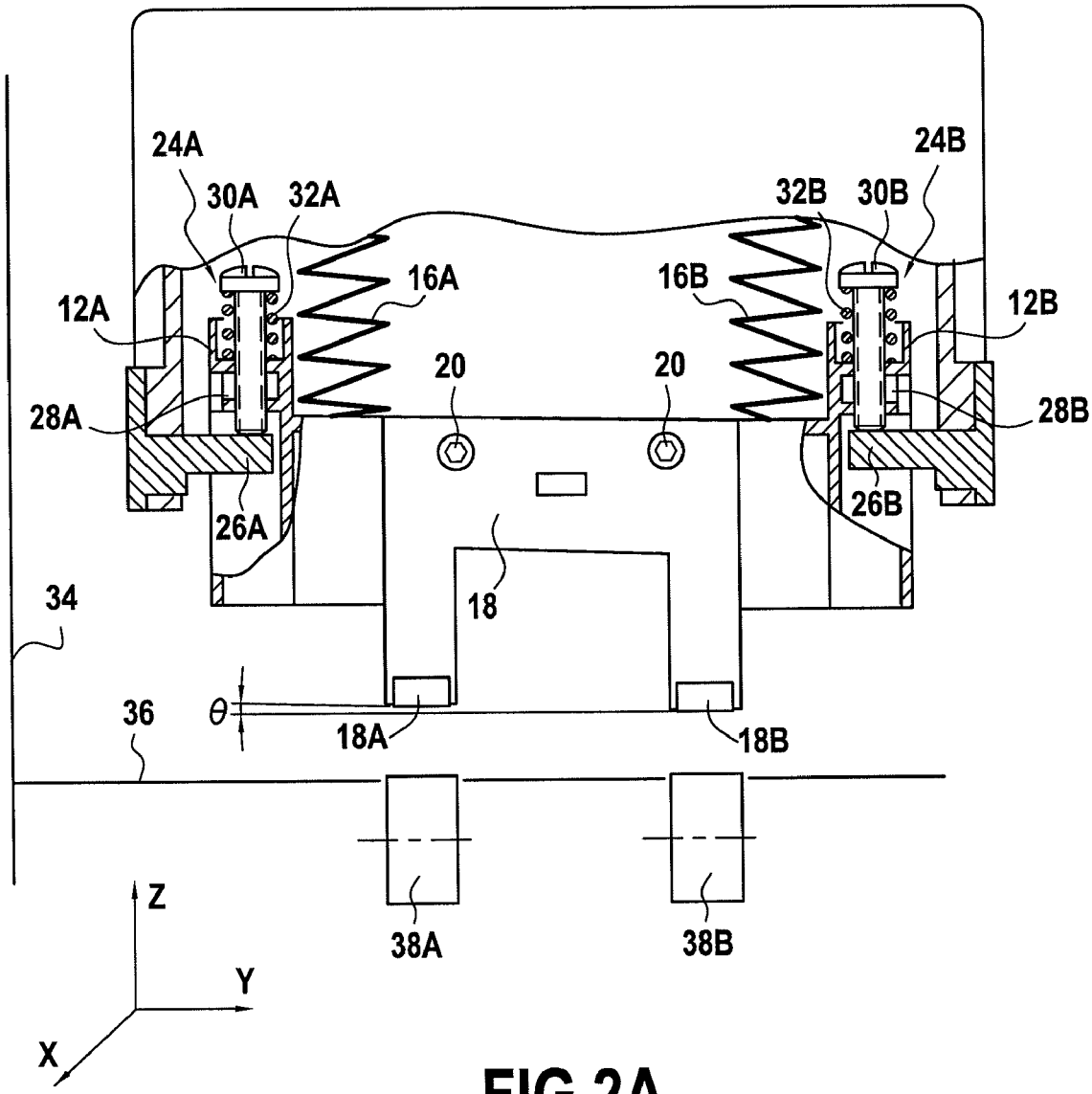

In accordance with the invention, in order to straighten up the mailpieces passing under the guide, it is proposed, as shown in FIG. 2A to release the front top corner of each of the mailpieces by slightly inclining the guide (along the Y axis) relative to the horizontal plane of the deck, the distance between the low end portion of said guide and the deck being greater at that portion of said guide that is closer to the referencing wall than at that portion of said guide that is further away therefrom, said guide remaining in its plane that is perpendicular to the referencing wall.

Inclining the guide, by an angle $\theta$, is obtained by asymmetrically adjusting the distance between the deck and the guide, and, more particularly, in the example shown, by asymmetric adjustment means constituted by two screw-and-nut sets 24A, 24B, each acting in opposition to an abutment 26A, 26B that is stationary relative to the frame 22 of the device. Each of the screw-and-nut sets is mounted in a portion 12A, 12B extending, for example, above and on either side of the body of the guide, i.e. respectively on the same side as the referencing wall and on the other side, which, in practice, is the same side as the operator of the franking machine. This portion of body receives a stationary nut 28A, 28B into which an adjustment screw 30A, 30B is screwed, which screw is also held snugly in said portion of body by a resilient element such as a spring 32A, 32B.

The selector device of the invention operates as follows. Once the mailpieces to be processed have been placed on the deck of the feeder, they are inserted into the selector device and extracted one by one by the guide. When there are only a few mailpieces remaining, then due to the guide being inclined by an angle $\theta$, in accordance with the invention, the first contact between the mailpiece and the finger that is closest to the operator tends to press the rear portion of the mailpiece against the referencing wall 34, thereby making it possible to keep the mailpiece properly in reference, especially if the mailpiece-receiving deck 36 is equipped with drive rollers 38A, 38B that are inclined relative to the transport direction. Inclining the guide at the angle $\theta$ is obtained, for example, by acting on the first adjustment screw 30B, which is preferably the screw that is disposed on the same side as the operator, so as to adjust the distance between the deck and the guide to a first predetermined height, and so as thus to position the guide horizontally relative to the mailpiece-receiving deck, and then by acting on the second adjustment screw 30A, which is the screw disposed on the same side as the referencing wall, so as, by adjusting the distance between the deck and the guide to a second predetermined height, to deform the plastics material body of the guide, thereby inclining the guide relative to the mailpiece-receiving deck 36. This deformation is possible due to the relative flexibility of said body, due to the material of which it is made, but above all due to the fact that, when, as in the example shown, the comb has two central teeth only, the mean height offset between the selector fingers that it has is about 0.3 mm for a guide that has a width of 100 mm.

Thus, with the present invention, the mailpieces skewing at the end of the stack, due to the extra thickness of the flap, is avoided because, by enabling said mailpieces to engage under the guide where the height is the largest, a jogging effect or a skew compensation effect can be generated.

What is claimed is:

1. A mailpiece selector device comprising a guide cooperating with a plurality of opposite selector rollers passing through a deck for receiving a stack of mailpieces, said guide co-operating with said rollers to select said mailpieces one-by-one and to transport them downstream, wherein said guide presents a predetermined inclination at an angle $\theta$ relative to a horizontal plane defined by said deck in a direction perpendicular to the transport direction, with a distance between said deck and a low end portion of said guide that is larger at the portion of said guide that is closer to a referencing wall than at the portion of said guide that is further away from said referencing wall.

2. A mailpiece selector device according to claim 1, wherein said guide has a body that is hinged about a pivot axis and that can pivot in opposition to resilient return means as the mailpieces pass over said plurality of selector rollers, and a front portion forming a comb that is fastened to said body, a selector finger coated with a wear-resistant material being fastened to the end of each of the teeth of said comb.

3. A mailpiece selector device according to claim 2, wherein said material of said selector finger is a ceramic or a carbide.

4. A mailpiece selector device according to claim 2, wherein said body of the guide is made of a plastics material.

5. A mailpiece selector device according to claim 4, wherein said inclination at said angle $\theta$ is obtained by asymmetric adjustment means acting by deforming said body of the guide.

6. A mailpiece selector device according to claim 5, wherein said asymmetric adjustment means comprise two screw-and-nut sets, each of which acts in opposition to an abutment that is stationary relative to a framework of the device, each of said two screw-and-nut sets being mounted in two portions disposed on either side of the body.

7. A mailpiece selector device according to claim 6, wherein said portion of the body receives a stationary nut into which an adjustment screw is screwed, which screw is held snugly in said portion of the body by a resilient element.

8. A mailpiece feeder for a franking machine, which feeder includes a mailpiece selector device according to claim 1.

* * * * *